United States Patent [19]

Schierwagen et al.

[11] 4,268,897

[45] May 19, 1981

[54] SELF-LOCKING LOUVER FOR LIGHTING FIXTURE

[75] Inventors: Alfred W. Schierwagen, Richmond Hill; Thomas D. La Mountain, Syosset, both of N.Y.

[73] Assignee: Templet Industries, Inc., Plainview, N.Y.

[21] Appl. No.: 59,688

[22] Filed: Jul. 23, 1979

[51] Int. Cl.[3] ..... F21V 17/02

[52] U.S. Cl. ..... 362/325; 362/226; 362/210; 362/342

[58] Field of Search ..... 362/226, 290, 325, 342, 362/352, 353, 354

[56] References Cited

U.S. PATENT DOCUMENTS

| | | | |
|---|---|---|---|
| 2,794,116 | 5/1967 | Morin | 362/353 |
| 2,971,083 | 2/1961 | Phillips et al. | 362/342 |
| 3,024,355 | 3/1962 | Lipscomb | 362/342 |
| 3,378,980 | 4/1968 | Blitzer, Jr. | 362/290 X |
| 3,689,762 | 9/1972 | Shatan | 362/352 X |
| 3,774,024 | 11/1973 | Deaton | 362/342 X |
| 3,872,297 | 3/1975 | Rohlof | 362/292 |
| 4,059,754 | 11/1977 | Lewin | 362/342 X |
| 4,104,712 | 8/1978 | Häfner | 362/226 X |

FOREIGN PATENT DOCUMENTS

| | | | |
|---|---|---|---|
| 432982 | 5/1967 | Switzerland | 362/342 |
| 993402 | 5/1965 | United Kingdom | 362/342 |

*Primary Examiner*—Peter A. Nelson
*Attorney, Agent, or Firm*—Kirschstein, Kirschstein, Ottinger & Cobrin

[57] ABSTRACT

An easy-to-assemble, self-locking, low brightness louver for a fluorescent lamp lighting fixture is comprised of a plurality of longitudinally-extending light baffles which are aligned at right angles to a corresponding plurality of transversely-extending light baffles. The baffles are assembled and locked with snap-type action in a criss-crossed grid-type lattice arrangement to form a unitary structure.

14 Claims, 9 Drawing Figures

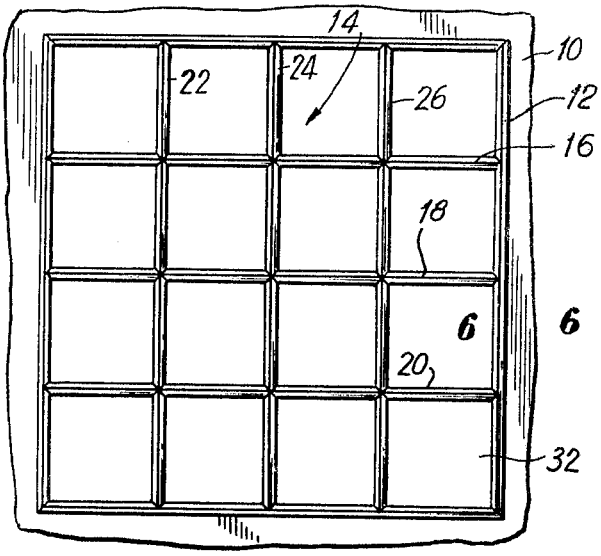
FIG. 1
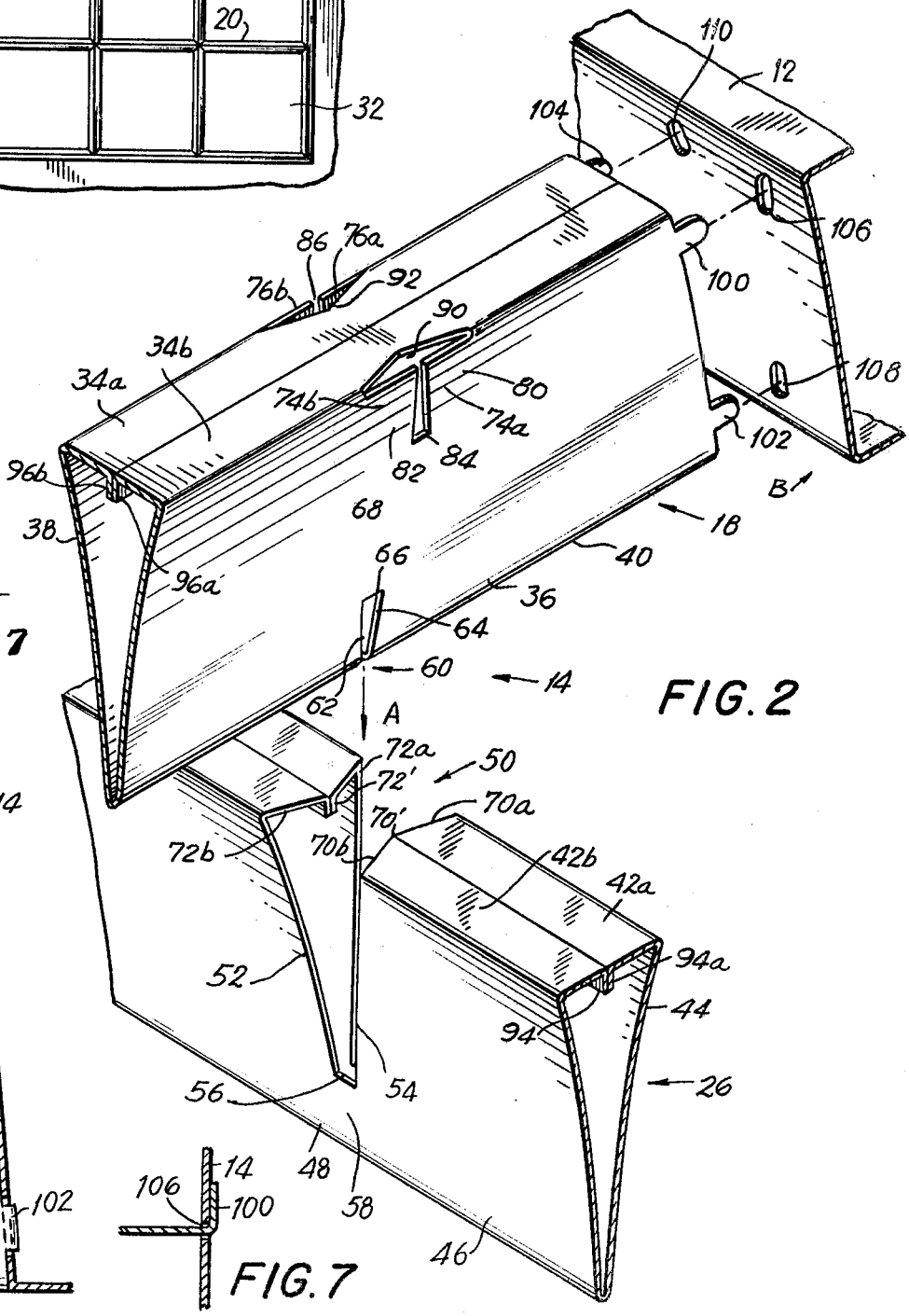
FIG. 2
FIG. 6
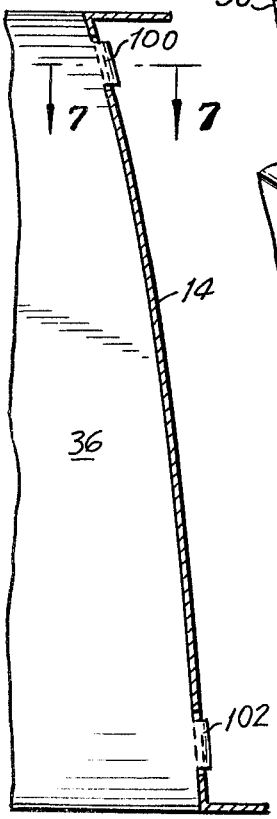
FIG. 7

SELF-LOCKING LOUVER FOR LIGHTING FIXTURE

BACKGROUND OF THE INVENTION

1. Field of the Invention

This invention generally relates to low brightness louvers for fluorescent lamp lighting fixtures and, more particularly, to a novel louver construction which is easy to assemble at the site of the fixture.

2. Description of Prior Art

Low brightness louvers are mounted directly below a recessed ceiling fluorescent lamp fixture for efficiently utilizing the light emitted by the lamp. The louvers direct the light away from the ceiling and walls and instead towards the interior of the room. As used in this specification, low brightness indicates a condition where there is minimum glare and wasted light.

Louver constructions which utilize a plurality of light baffles are disclosed by U.S. Pat. Nos. 2,337,347; 2,506,951; 2,591,661; 2,971,083; 3,246,138; and 3,591,798. Although generally satisfactory for their intended purpose, these louver constructions suffer from such drawbacks, as, inter alia, the high cost of manufacturing and assembly, the difficulty to assemble such louvers at the site of the lighting fixture, and the leakage of light within the baffles themselves.

Some early louver designs are manufactured entirely by injection molding techniques, and these moled plastic constructions are not only difficult to fabricate, but also constitute a safety hazard when attacked by fire. Other prior louver designs are assembled by inserting one set of baffles in place in slots formed in another set of baffles. These latter designs require external angle bracing and hidden gusset plates for stiffening the interlocking baffles, all of which adds to and further complicates the overall assembly.

SUMMARY OF THE INVENTION

1. Objects of the Invention

Accordingly, is an object of this invention to overcome the aforementioned drawbacks of the prior art.

Another object of this invention is to provide a novel louver construction which is easy to assemble and manufacture.

Still another object of this invention is to quickly assemble a louver from baffles which are interconnected by one-motion, snap-type action.

An object of this invention is to assemble a louver at the site of the lighting fixture.

Another object of this invention is to ship baffles in a flat or knock-down condition to efficiently utilize available shipping space.

Still another object of this invention is to eliminate injection plastic molded techniques and massive external supplemental bracing frames.

An object of this invention is to provide a novel baffle-type louver construction which is resistant to light leakage within the baffles, particularly at the baffle interconnecting points.

Another object of this invention is to efficiently direct light towards a user, rather than towards the room walls or ceiling.

2. Features of the Invention

In accordance with these objects and others, which will become apparent hereinafter, one feature of this invention resides, briefly stated, in an easy-to-assemble self-locking, low brightness louver for a lighting fixture which has an elongated light source. This louver comprises a plurality of elonated light baffles of generally triangular cross-section. Each baffle has a top wall which faces the light source, and a pair of concavely-curved side walls which converge from opposite sides of the top wall along predetermined parabolic paths and meet at a common lower edge which is located below the light source in a generally horizontal plane, thereby defining, relative to the latter, a cutoff angle with direct light emitted from the light source. Each side wall has a reflective specular finish which reflects light emitted from the light source at angles with respect to the horizontal plane which are at least equal to the given cutoff angle.

The louver further comprises assembly means which align a first set of baffles in a direction generally longitudinally of the light source, and align a second set of baffles in a direction generally transverse of the light source. Both the longitudinal and transverse baffles are assembled in a criss-crossed, grid-type lattice arrangement which forms a plurality of light passageways bounded by specular side walls.

Finally, the louver comprises self-locking means which interlock the longitudinal and transverse baffles in the above-mentioned lattice arrangement with snap-type action. This self-locking means eliminates the massive supplemental bracing required by the prior art, and also permits the louver to be assembled easily and quickly at the site of the lighting fixture, if desired.

Another feature of the invention resides in the prevention of light leakage directly into the interiors of the baffles themselves. Even though the self-locking means forms locking apertures at the top wall of each baffle, through which light might otherwise leak in, each locking aperture is sealed in light-tight arrangement with a correspondingly-contoured locking or camming projection. Light, therefore, cannot enter into the interior of each baffle. This minimizes light losses and maximizes light utilization.

The novel features which are considered as characteristic for the invention are set forth in particular in the appended claims. The invention itself, however, both as to its construction and method of operation, together with additional objects and advantages thereof, will be best understood from the following description of specific embodiments when read in connection with the accompanying drawings.

BRIEF DESCRIPTION OF THE DRAWINGS

FIG. 1 is a bottom view of the louver of the present invention;

FIG. 2 is an exploded partially sectioned perspective view showing how the baffles are interconnected to each other and to a frame;

FIG. 6 is a sectional view of the connection of the baffle with the frame as taken along line 6—6 of FIG. 1;

FIG. 7 is a sectional view of the connection of the baffle with the frame as taken along line 7—7 of FIG. 6;

DETAILED DESCRIPTION OF THE PREFERRED EMBODIMENTS

Figure 3:
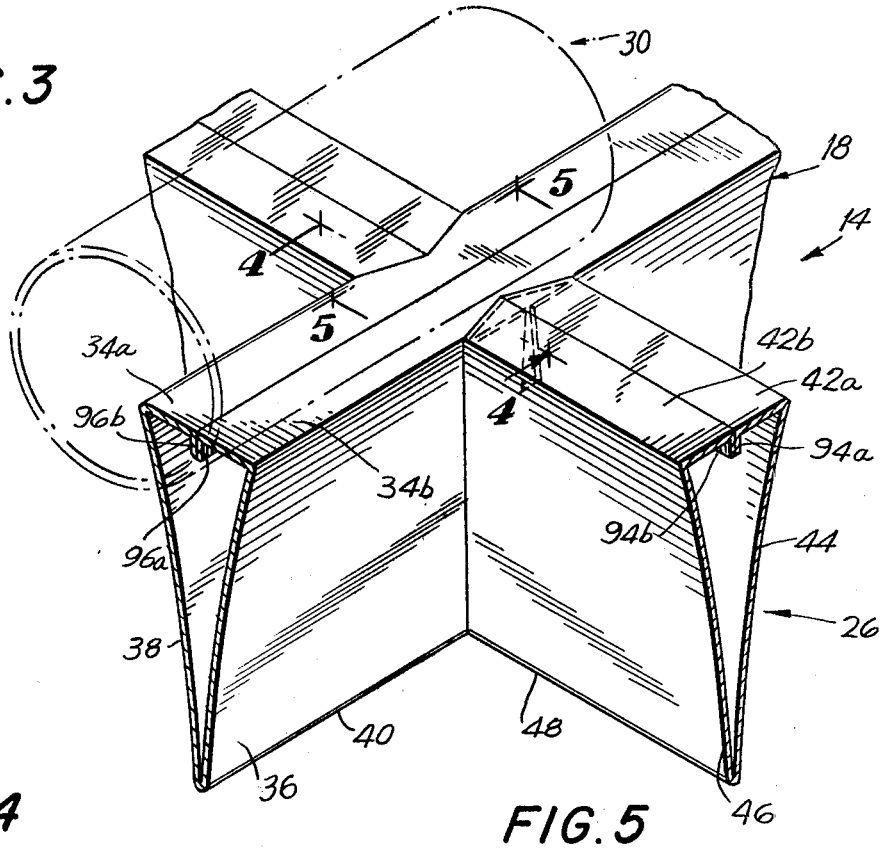
FIG. 3 is a partial perspective view of the assembled louver and shows an elongated fluorescent lamp in phantom lines above the louver.
Figure 4:
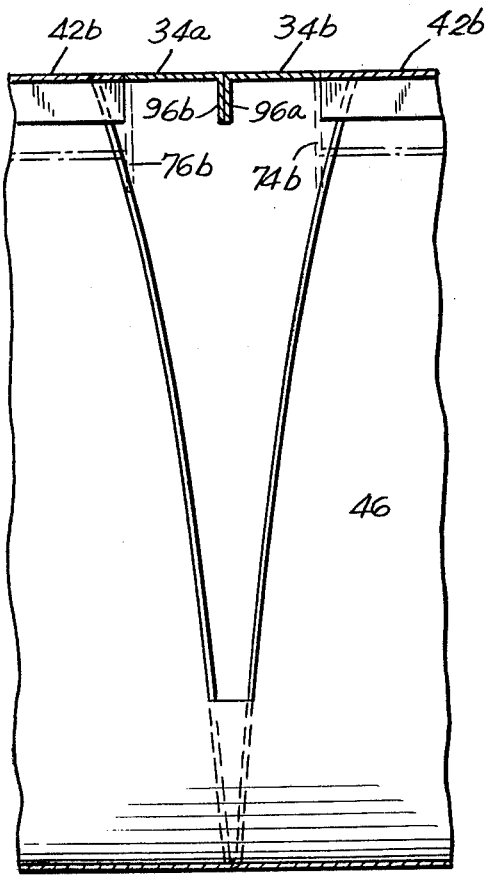
FIG. 4 is a sectional view of the louver as taken along line 4—4 of FIG. 3.
Figure 5:
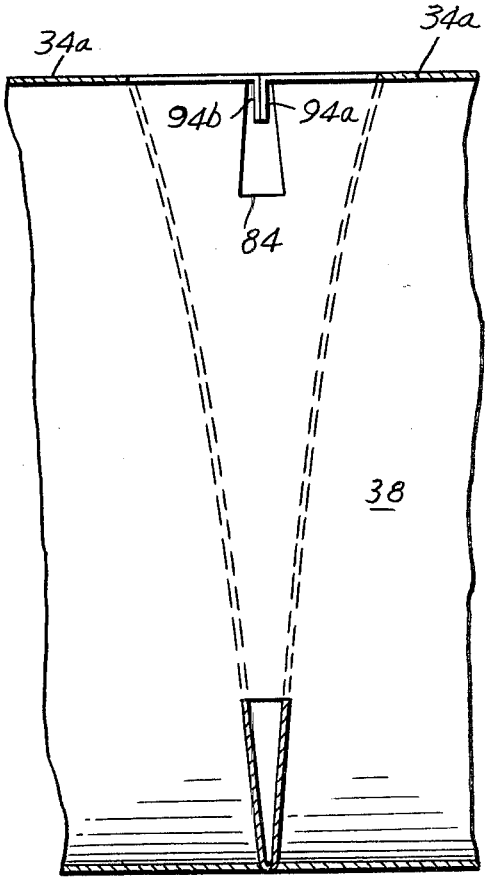
FIG. 5 is a sectional view of the louver as taken along line 5—5 of FIG. 3.

Referring now to the drawings, reference numeral 10 in FIG. 1 identifies a ceiling in which a lighting fixture is recessed. The lighting fixture has one, or preferably, a plurality of fluorescent tubes or lamps and non-illustrated conventinal starter ballast. A generally rectangular mounting frame 12 surrounds and is mounted on the fixture. The louver 14, which is assembled as a criss-crossed, grid-type, unitized lattice arrangement which resembles an egg crate partition arrangement, is mounted on the frame 12 underneath the fluorescent lamps.

As best shown in FIG. 1, the louver 14 includes a first set of light baffles 16, 18, 20, all of which are in mutual parallelism and which extend in a direction generally lengthwise of the elongated tubular lamp. See, for example, representative longitudinal baffle 18 in FIG. 3 which extends lengthwise of representative lamp 30.

The louver 14 includes a second set of light baffles 22, 24, 26, all of which are in mutual parallelism and which extend in another transverse direction that is generally at right angles to the elongation of the lamp 30. See, for example, representative longitudinal baffle 18 in FIG. 3 which is normal to representative transverse baffle 26.

Any number of longitudinal and/or transverse baffles can be utilized to form the lattice arrangement without departing from the spirit of this invention. For ease of description purposes only, three longitudinal baffles 16, 18, 20 are shown interconnected to three transverse baffles 22, 24, 26 to form, together with the frame 12, sixteen passageways, e.g. passageway 32, through which light passes from the lamp 30 at the upper side of the louver, to the interior of the room to be illuminated at the lower side of the louver. Each light passageway is shown as generally square-shaped, as seen from below the louver. It will be understood that shapes other than squares are likewise intended to be covered by this invention.

Each baffle has a generally triangular cross-section which has a top wall which faces the lamp 30 and a pair of concavely-curved side walls which converge from opposite sides of the top wall along predetermined parabolic paths until they meet at a common lower edge. Representative longitudinal baffle 18 has a top wall which is constituted of two sections 34*a*, 34*b*; a pair of side walls 36, 38; and a common lower edge 40. Representative transverse baffle 26 has a top wall constituted of two sections 42*a*, 42*b*; a pair of side walls 44, 46; and a common lower edge 48.

As shown in the assembled configuration of FIG. 3, all of the common lower edges 40, 48 lie in the same generally horizontal plane. The lower edges 40, 48 are spaced below the lamp 30 such that a direct light ray extending along a straight line from the lamp to any lower edge defines a cutoff angle relative to the horizontal plane. The normal cutoff angle is measured between the horizontal plane of the light fixture and the line along which direct light rays are barely perceptible. For overhead lighting fixtures, this cutoff angle is usually selected between 25 and 55 degrees depending upon the parameters of the room. This angle is determined to provide minimal direct perception of the light source by the occupants of a typical illumination area, yet with maximum efficiency of the unit, i.e. maximum illumination of the area.

Each parabolic side wall has a semi-specular or reflective finish operative for reflecting light emitted from the lamp at angles with respect to the aforementioned horizontal plane which is at least equal to, or preferably greater than, the given cutoff angle. Each passageway 32 is bounded by four such parabolic side walls to thereby confine light rays passing through the passageway to a confined sector of the room. Aluminum, alloys thereof, galvanized ion, magnesium, alloys thereof, and plastics coated with a reflective film represent examples of reflective materials which can constitute each baffle.

The longitudinal and transverse baffles are assembled as indicated in FIG. 2. A plurality of wedge-like openings, e.g. opening 50, are equidistantly spaced lengthwise of each transverse baffle 26. Each opening 50 has an upper open end at the top wall sections 42*a*, 42*b*. Each opening 50 has convexly-curved side edges 52, 54 on each side wall 44, 46 which converge from the top wall sections towards each other in direction towards the common lower edge 48. The side edges 52, 54 terminate short of the edge 48 at a closed end 56 which extends between the edges 52, 54 along a line which is generally parallel to the lower edge 48. The remaining side wall portions 58 is located between the closed end 56 and the lower edge 48.

A plurality of dovetailed openings, e.g. opening 60 are equidistantly spaced lengthwise of each longitudinal baffle 18. Each opening 60 has a lower open end at the lower common edge 40. Each opening 60 has tapered side edges 62, 64 on each side wall 36, 38 which diverge from the lower edge 40 away from each other in direction towards the top wall sections 34*a*, 34*b*. The tapered side edges 62, 64 terminate short of the top wall sections 34*a*, 34*b* at a closed end 66 which extends between the edges 62, 64 along a line which is generally parallel to the lower edge 40. The remaining side wall portions 68 is located between the closed end 66 and the top wall sections 34*a*, 34*b*.

The baffles are assembled by aligning opening 60 with opening 50 and by moving baffle 18 in direction of arrow A into the opening 50 of baffle 26. The wall portions 58 are received in the dovetailed opening 60 to firmly hold the lower interconnecting regions of baffles 18, 26 from moving apart of each other in direction lengthwise of baffle 18. The wall portions 68 are received in the wedge-shaped opening 50 to firmly hold the upper interconnecting regions of baffles 18, 26 from moving apart of each other in directin lengthwise of baffle 26. Assembly is facilitated by squeezing the opposite wall portions 58 towards each other so that they easily fit within the open end of opening 60. As shown in FIG. 3, all of the top wall sections 34*a*, 34*b* and 42*a*, 42*b* lie generally in a horizontal plane above the aforementioned horizontal plane in which the lower common edges 40, 48 lie. In other words, the height of wall portions 58 and 68 are respectively substantially equal to the height of openings 60 and 58.

In accordance with the present invention, self-locking means are provided on the baffles for interlocking the latter in said lattice arrangement with snap-type action. The self-locking means includes a pair of camming projections 70*a*, 70*b* on the top wall sections 42*a*, 42*b* at one side of opening 50, and another pair of camming projections 72*a*, 72*b* at the other side of each opening 50. The self-locking means also includes a pair of deflectable tongues 74*a*, 74*b* on side wall 36 of baffle 18 and another pair of deflectable tongues 76*a*, 76*b* on the opposite side wall 38 of baffle 18.

Each tongue 74*a*, 74*b*; 76*a*, 76*b* is generally triangularly shaped and bendable along bend lines 80, 82. Slots 84, 86 are formed in each side wall intermediate the respective tongue pairs. The camming projections taper inwardly into the open end of opening 50 such that each pair of camming projections together constitute a generally triangular configuration. This latter triangular configuration for the camming projections is duplicated for the locking apertures 90, 92, respectively found in the top wall sections 34*b*, 34*a*.

Before insertion of the baffles in direction of arrow A, each tongue is initially in an unstressed unlocked position. During such insertion, each tongue is moved to intermediate deflected positions by the respectively associated camming projection which pushes the respective tongue inwardly of the baffle 18. With the tongues progressively pushed out of the way, the camming projections are free to move even further upward. Eventually, the camming projections move past and clear the upper edge of each resilient tongue, whereupon each tongue due to its inherent resiliency snaps back behind the tongue, thereby securely locking the two baffles together.

As best shown in FIG. 3, the triangular configuration for the camming projection pairs are received snugly, i.e. in light-tight sealing engagement, in the triangularly configurated locking apertures 90, 92. This means that the light rays emitted from lamp 30 will not undesirably leak into the interior of the baffles. Such undesirable light losses are thereby minimized.

In addition, the side walls of the longitudinal and transverse baffles snappingly engage each other. The top wall sections 42*a*, 42*b* and 34*a*, 34*b* are pressed snugly, i.e. in light-tight sealing engagement, against each other to further prevent light leakage into the baffle interiors.

In order to prevent the respective top wall sections from overlapping each other, bent flange portions 94*a*, 94*b* on top wall sections 42*a*, 42*b* abuttingly engage each other. Bent flange portions 96*a*, 96*b* on top wall sections 34*a*, 34*b* also abuttingly engage each other.

Also, the slots 84, 86 receive the apex or tip regions of the triangularly configurated pairs of camming projections. The tips 70', 72' are thus respectively guided along the slots 84, 86 during the assembly and locking operation to prevent undesirable relative slippage during assembly.

The self-locking louver described above can be assembled in situ at the lighting fixture. The unitized construction can be mounted to the frame 14 by means of bendable tabs 100, 102, 104 which are first inserted in direction of arrow B into mounting slots 106, 108, 110, respectively, and which are thereupon bent over, as best shown in FIGS. 6 and 7. Two tabs 100, 102 are mounted at one end edge of side wall 36 of baffle 18; the third tab 104 is mounted at the same end of side wall 38 of baffle 18. Of course, any number of tabs could be utilized on either side wall of either or both sets of baffles, all of these possibilities being intended to be covered by this invention.

The frame element side walls of the frame 14 are likewise parabolic shaped in mirror image relationship to the baffle side wall which faces the respective frame element. Thus, each passageway 32 has a generally frusto-pyramidal configuration.

Figure 8:
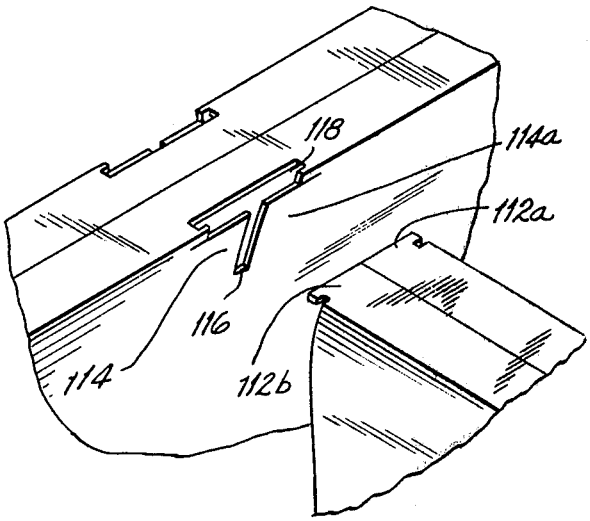
FIG. 8 is a perspective view of an alternative locking means in accordance with this invention.

FIG. 8 is a schematic of an alternative type of snap-action self-locking means. Camming projections 112*a*, 112*b* in a pair of top wall sections is operative, in the same manner as camming projections, 70*a*, 70*b* for deflecting resilient tongues 114*a*, 114*b* which are separated by slot 116. The composite cross-section of camming projections 112*a*, 112*b* resembles a rectangle, and this latter shape is duplicated for the rectangularly-shaped locking aperture 118, to thereby make a light-tight seal as described above.

The louver and frame are installed as a unit by haning or lockingly mounting the unit below the fluorescent fixture housing. This will cause a cutoff of light at an angle of from about 30° to about 45°, depending upon the parabolic curvature of the side walls and the relative location of the light source. The further away the light source, the lower the angle of light reflecting into the room. The metal structure can be made in lengths up to four to eight feet long, without appreciable sagging because of the inherent strength of the snapped-together structure.

The self-locking means of FIGS. 1–8 interconnect the baffles with snap-type action in a manner such that the interconnected baffles are not readily disassembled, i.e. once snapped in place, the baffles can be separated from each other only after slightly distorting the baffles in the vicinity of the snappingly-engaged projections, tongues and locking apertures.

Figure 9:
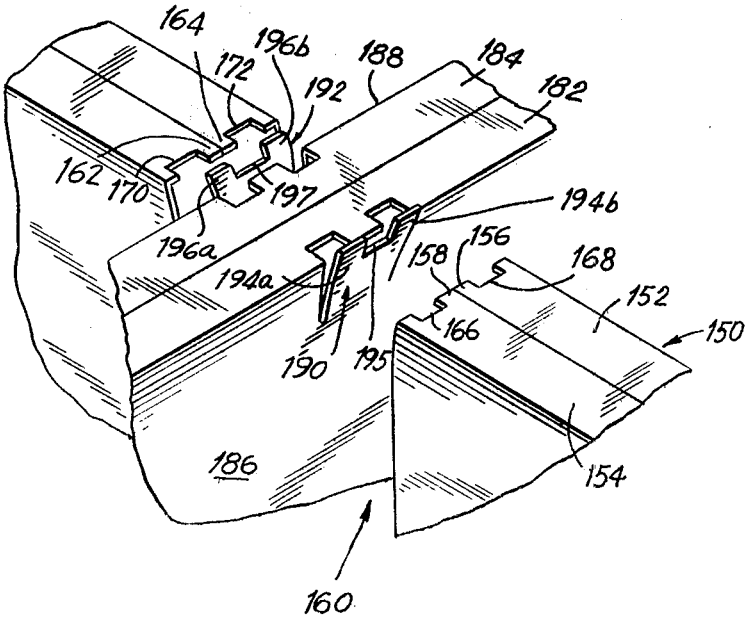
FIG. 9 is a perspective view of another alternative locking means in accordance with this invention.

An alternative self-locking arrangement is shown in FIG. 9 wherein the baffles are more readily disassembleable. Transverse baffle 150 has top wall sections 152, 154, each having a pair of camming projections 156, 158 at one side of opening 160 and another air of camming projections 162, 164 at the opposite side of opening 160. Cutouts 166, 168, 170, 172 are formed on the top wall sections 152, 154.

As for the longitudinal baffle 180, it has top wall sections 182, 184 and side walls 186, 188. Deflectable resilient tongues 190, 192 are integrally formed on side walls 186, 188. The tongues each have tangs 194*a*, 194*b*; 196*a*, 196*b* which are respectively separated by notches 195, 197.

When baffle 180 is inserted into opening 160 of baffle 150, the camming projections urge the respective tongues 190, 192 towards each other. When the camming projections reach the lower edges of notches 195, 197, the resilient tongues snap back towards their initial positions. In the locked condition, tongues 194*a*, 194*b* and 196*a*, 196*b* are respectively received in cutoffs 166, 168, 170, 172.

In order to detach the baffles of FIG. 9, it is merely necessary to squeeze the tangs at opposite sides of the baffle 180 towards each other, and thereupon to lift the baffle 180 in a direction opposite to the direction of insertion. The tangs are squeezed together for a distance sufficient to cause the camming projections to clear their corresponding notches.

It will be understood that each of the elements described above, or two or more together, may also find a useful application in other types of constructions differing from the types described above.

While the invention has been illustrated and described as embodied in a self-locking louver for lighting fixture, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An easy-to-assemble, self-locking, low brightness louver for a lighting fixture of the type having an elongated light source, comprising:

(a) a plurality of elongated light baffles of generally triangular cross-section, each baffles having a top wall which faces the light source, and a pair of concavely-curved side walls which converge from opposite sides of the top wall along predetermined parabolic paths and which meet at a common lower edge that is located below the light source in a genrally horizontal plane to thereby define relative to the latter a cutoff angle with direct light emitted from the light source, each parabiolic side wall having a reflective specular finish being adapted for reflecting light emitted from the light source at angles with respect to the horizontal plane which are at least equal to the given cutoff angle;

(b) assembly means for alingning a first set of the baffles in a direction generally longitudinally of the light source, and for aligning a second set of the baffles in a direction generally transversely of the light source, both longitudinal and transverse baffles being assembled in a criss-crossed, grid-type lattice arrangement which forms a plurality of light passageways bounded by the parabolic side walls; and (c) self-locking means for snappingly interengaging the longitudinal and transverse baffles in said lattice arrangement with snap-type action, whereby a louver of unitized construction may be quickly and easily snappingly assembled at the site of the lighting fixture.

2. The louver as defined in claim 1; and further comprising a frame adapted for mounting on the lighting fixture, and detachable means for detachably mounting the longitudinal and transverse baffles on the frame.

3. The louver as defined in claim 2, wherein said detachable mounting means includes bendable tabs at opposite end regions of the baffles, and wherein said frame has slots for receiving said tabs.

4. An easy-to-assemble, self-locking, low brightness louver for a lighting fixture of the type having an elongated light source, comprising:

(a) a plurality of elongated light baffles of generally triangular cross-section, each baffle having a top wall which faces the light source, and a pair of concavely-curved side walls which converge from opposite sides of the top wall along predetermined parabolic paths and which meet at a common lower edge that is located below the light source in a generally horizontal plane to thereby define relative to the latter a cutoff angle with direct light emitted from the light source, each parabolic side wall having a reflective specular finish being adapted for reflecting light emitted from the light source at angles with respect to the horizontal plane which are at least equal to the given cutoff angle;

(b) assembly means for aligning a first set of the baffles in a direction generally longitudinally of the light source, and for aligning a second set of the baffles in a direction generally transversely of the light source, both longitudinal and transverse baffles being assembled in a criss-crossed, grid-type lattice arrangement which forms a plurality of light passageways bounded by the parabolic side walls, said assembly means including first wall means on one set of baffles for forming a plurality of wedge-like openings on each baffle of said one set, said first wall means bounding an open end at the top wall of the respective baffle and having convexly-curved side edges which converge towards each other towards the respective common lower edge but short thereof along parabolic paths to thereby form the remaining first side wall portions proximate to the lower edge, said assembly means further including second wall means on another set of baffles for forming a plurality of dovetailed openings on each baffle of said other set, said second wall means bounding an open end at the lower common edge of the respective baffle and having tapered side edges which diverge outwardly away from each other towards the respective top wall but terminating short thereof to thereby form the remaining second side wall portions proximate to the top wall, said second side wall portions being snappingly engaged by said convexly-curved side edges, and said first side wall portions being snappingly engaged by said tapered side edges; and (c) self-locking means for interlocking the longitudinal and transverse baffles in said lattice arrangement with snap-type action, whereby a louver of unitized construction may be quickly and easily assembled at the site of the lighting fixture.

5. The louver as defined in claim 4, wherein said convexly-curved side edges terminate short of their respective common lower edge by a predetermined distance, and wherein said tapered side edges terminate away from their respective common lower edge at a distance generally the same as said predetermined distance such that the common lower edges of said one and said other baffles generally lie in the same horizontal plane.

6. The louver as defined in claim 4, wherein both said first and said second wall means have a closed end opposite to their respective open ends, each closed end extending lengthwise of the respective common lower edge between the respective side edges.

7. The louver as defined in claim 1, wherein said self-locking means includes camming means on one set of the baffles, and resilient means on another set of the baffles and being movable by said camming means.

8. An easy-to-assemble, self-locking, low brightness louver for a lighting fixture of the type having an elongated light source, comprising:

(a) a plurality of elongated light baffles of generally triangular cross-section, each baffle having a top wall which faces the light source, and a pair of concavely-curved side walls which converge from opposite sides of the top wall along predetermined parabolic paths and which meet at a common lower edge that is located below the light source in a generally horizontal plane to thereby define relative to the latter a cutoff angle with direct light emitted from the light source, each parabolic side wall having a relfective specular finish being adapted for reflecting light emitted from the light source at angles with respect to the horizontal plane which are at least equal to the given cutoff angle;

(b) assembly means for aligning a first set of the baffles in a direction generally longitudinally of the light source, and for aligning a second set of the baffles in a direction generally transversely of the light source, both longitudinal and transverse baffles being assembled in a criss-crossed, grid-type lattice arrangment which forms a plurality of light passageways bounded by the parabolic side walls; and (c) self-locking means for interlocking the longitudinal and transverse baffles in said lattice arrangment with snap-type action, whereby a louver of unitized construction may be quickly and easily assembled at the site of the lighting fixture, said self-locking means including camming means on one set of the baffles, and resilient means on anothwer set of the baffles and being movable by said camming means, said camming means including a camming projection, and wherein said resilient means includes a deflectable tongue which is movable by said camming projection from an end-limiting unstressed unlocked position, to an intermediate deflected position in which said camming projection engages and displaces the tongue, and thereupon to an end-limiting unstressed locked position in which said camming projection clears and thereupon snappingly engages behind the tongue to thereby interlock the latter to the projection.

9. The louver as defined in claim 8, wherein said camming projection has a predetermined contour on the top wall of a baffle of said one set, and wherein the top wall of an interlocking baffle of said other set has wall means bounding a locking aperture of complementary contour to said predetermined contour, said aperture substantially completely receiving said corresponding camming projection in light-resistant sealing engagement.

10. The louver as defined in claim 9, wherein said camming means includes another camming projection in mirror-image relationship with said first-mentioned camming projection and constituting a pair therewith; and wherein said resilient means includes another deflectable tongue in mirror-image relationship with said first-mentioned tongue and constituting a pair therewith; and also comprising another locking aperture in mirror-image relationship with said first-mentioned locking aperture and constituting a pair therewith.

11. The louver as defined in claim 10, wherein said pair of tongues is integrally formed on one of said side walls of a respective baffle; and further comprising another pair of tongues on the other of said side walls of the respective baffle.

12. The louver as defined in claim 10, wherein the top wall constitutes a pair of top wall section, and wherein said pair of locking apertures is integrally formed on one of said top wall sections; and further comprising another pair of locking apertures on the other said top wall sections.

13. The louver as defined in claim 10, wherein the top wall constitutes a pair of camming projections is respectively mounted on said top wall sections; and further comprising another pair of camming projections respectively mounted on said top wall sections.

14. The louver as defined in claim 1, wherein each top wall has a pair of top wall sections; and further comprising means for preventing said top wall sections from overlapping each other, including a pair of bent flange portions respectively mounted on each top wall section and abutting each other in light-resistant sealing engagement.

* * * * *